US005984669A

United States Patent [19]

Rosada et al.

[11] Patent Number: 5,984,669

[45] **Date of Patent: *Nov. 16, 1999**

[54] LIGHTER WITH A TINTED FLAME, A TINTING COMPOSITION THEREFOR, AND A REFILL ELEMENT

[75] Inventors: Jean-Pierre Rosada; Christine Lapene; Christian Authie, all of Muret, France

[73] Assignee: Etienne Lacroix Tous Artifices S.A., Muret, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,172

[22] PCT Filed: Nov. 30, 1994

[86] PCT No.: PCT/FR94/01397

§ 371 Date: Nov. 5, 1996

§ 102(e) Date: Nov. 5, 1996

[87] PCT Pub. No.: WO95/15464

PCT Pub. Date: Jun. 8, 1995

[30] Foreign Application Priority Data

| | | | |
|---|---|---|---|
| Nov. 30, 1993 | [FR] | France | 93 14300 |
| Mar. 10, 1994 | [FR] | France | 94 02768 |
| Jul. 13, 1994 | [FR] | France | 94 08754 |

[51] Int. Cl.[6] ..... F23D 11/44

[52] U.S. Cl. ..... 431/243; 431/126; 431/277

[58] Field of Search ..... 431/126, 150, 431/243, 254, 276, 277, 344

[56] References Cited

U.S. PATENT DOCUMENTS

| | | | |
|---|---|---|---|
| 3,152,460 | 10/1964 | Piffath | 431/276 |
| 3,439,993 | 4/1969 | Neufeldt | 431/243 |
| 3,523,005 | 8/1970 | Piffath et al. | 431/277 |
| 4,375,954 | 3/1983 | Trudel | 431/243 |
| 4,895,511 | 1/1990 | Schmid. . | |

FOREIGN PATENT DOCUMENTS

| | | | |
|---|---|---|---|
| 253828 | 4/1967 | Austria | 431/254 |
| 1 036 482 | 9/1953 | France . | |
| 2 371 633 | 11/1976 | France . | |
| 2 615 597 | 5/1987 | France . | |
| 2 650 370 | 7/1989 | France . | |
| 2 650 876 | 8/1989 | France . | |
| 2 675 243 | 3/1991 | France . | |
| 2222939 | 11/1972 | Germany | 431/126 |
| 63-058021 | 3/1988 | Japan . | |
| 4-240311 | 5/1992 | Japan . | |

*Primary Examiner*—Carroll Dority
*Attorney, Agent, or Firm*—Jacobson, Price, Holman & Stern, PLLC

[57] ABSTRACT

The invention relates to a tinted flame lighter having a tank (1000) suitable for containing a mixture (L) under pressure of a tinting agent and of a flammable volatile liquid. The lighter includes a porous filter (1020) suitable for expanding the mixture delivered to the outside of the tank for burning while it is at least partially in the liquid state, and means for feeding the porous filter with the mixture in the liquid state.

3 Claims, 7 Drawing Sheets

LIGHTER WITH A TINTED FLAME, A TINTING COMPOSITION THEREFOR, AND A REFILL ELEMENT

The present invention relates to the field of lighters producing a tinted flame.

Two methods of tinting the flame of a lighter are known.

The first consists in spraying a tinting agent onto the flame, e.g. a metal dissolved in an alcohol solution, which solution is contained in a specific tank separate from the tank containing the liquid fuel.

The second consists in directly mixing the tinting agent in the liquid fuel that is used to produce the flame of the lighter. This method is more difficult to implement than the first, particularly if it is desired for the liquid fuel to be a flammable volatile liquid that is stored under pressure, since it is necessary to ensure simultaneously that the tinting agent is properly mixed in the flammable volatile liquid used and also that the tinting agent is entrained properly and regularly out from the lighter, in particular while avoiding premature dissociation of the mixture as it expands since that can lead to problems of the burner clogging or of the flame being irregularly tinted.

Japanese publication JP-A-63 058 021 describes a lighter containing in its tank both a tinting composition and a liquefied gas forming a phase that is distinct from the tinting composition and that overlies it.

In a first aspect, the present invention provides a novel lighter enabling the flame to be tinted by using a tinting agent mixed with a flammable volatile liquid stored under pressure in the same tank as the tinting agent.

According to a first advantageous characteristic of the invention, the mixture of tinting agent and of flammable volatile liquid forms only one liquid phase in the tank.

According to another advantageous characteristic of the invention, the lighter includes a porous filter suitable for expanding the flammable mixture delivered to the outside of the tank at least partially in the liquid state for burning and means for feeding said porous filter with said mixture in the liquid state. Preferably, at least one capillary tube is disposed in series with the porous filter.

The use of a porous filter fed with the flammable mixture in the liquid state, and preferably associated with at least one capillary tube, makes it possible to bring the mixture at least partially in the liquid state to the outside of the tank, thereby making it possible to avoid the above-mentioned problems by ensuring that the tinting agent is properly entrained outside the tank.

In a preferred embodiment of the invention, the mixture expanded by the porous filter is delivered into a vaporization duct situated outside the tank and subjected while the lighter is in use to the heat given off by the flame.

In some embodiments of the invention, the lighter includes a capillary tube extending downstream from the porous filter to deliver the mixture to the outside of the tank after it has passed through the porous filter. Advantageously, the inside diameter of the capillary tube extending downstream from the porous filter lies in the range 0.25 mm to 0.4 mm.

In an embodiment of the invention, the vaporization duct is formed by a vaporization duct tube connected end to end with one end of the capillary tube extending downstream from the porous filter, said vaporization duct tube having an inside diameter greater than the inside diameter of the capillary tube. The vaporization duct tube preferably has a curvilinear portion extending upwards around the axis of the flame and a free end opening out on the axis of the flame.

Advantageously, between its free end and said curvilinear portion, the vaporization duct tube has a downwardly inclined portion such that said free end is situated below a plane perpendicular to the axis of the flame and tangential to said curvilinear portion. Advantageously, the inside diameter of the vaporization duct tube lies in the range 0.5 mm and 1 mm.

In another embodiment of the invention, the vaporization duct is integrated in a part forming a flame guard. Advantageously, the vaporization duct is formed between two assembled together stamped metal sheets of the part forming the flame guard. Advantageously, the capillary tube situated downstream from the porous filter is connected to one end of the vaporization duct. The duct extends along a convex curve towards the axis of the flame and connects with an outlet tube opening out on the axis of the flame below a plane perpendicular to the axis of the flame and tangential to the top of said curve.

In another embodiment of the invention, the vaporization duct has a heat-conducting wire running along the inside thereof and extending from the duct into the core of the flame when the lighter is in use. The vaporization duct is then preferably formed in a body for closing the lighter.

Numerous known compositions have been proposed for tinting the flame of a lighter. Reference may be made, for example, to the following publications: FR-2 675 243, FR-2 651 861, FR-2 650 878, FR-2 639 635, and FR-2 615 597. To tint a flame, those publications describe the use of a borate in suspension in the butane of a liquefied gas lighter, of a gelled boron methanolate, or of metal salts in solution for impregnating the wick of a lighter. Those compositions do not give entire satisfaction.

In a second aspect, the invention provides a tinting composition suitable for use in a lighter of the above-specified type, in particular a composition that enables the flame of a butane gas lighter to be tinted.

According to the invention, this composition is characterized in that it comprises, in solution in alcohol, a tinting agent suitable, on burning, for imparting a desired tint to the flame. The alcohol in question is advantageously methanol or ethanol. The tinting agent may be a metal salt or an alkali metal salt, a derivative of boric acid, or an oxide of an alkali metal.

The composition can be used directly mixed with the butane of a gas lighter in the tank thereof, so as to be conveyed simultaneously with the gas to the outside of the tank for burning; in a variant, it may also be subjected to gelling treatment so as to be used subsequently in the form of a gel in the gas outlet duct of a lighter to charge the gas with tinting agent as it passes through; it may also be used to impregnate a medium, e.g. a porous substance, placed in the gas outlet duct of the lighter to charge the gas with tinting agent as it passes through.

Thus, in another aspect the invention also provides a butane gas lighter including such a composition, and a refill element for such a lighter, in the form of a liquid gas refill including the composition, a gel, or a medium impregnated with the composition.

In a first embodiment of a composition of the invention, intended to impart a green tint to the flame, the composition comprises 19 grams per liter (g/l) to 160 g/l of orthoboric acid in solution in methanol of purity greater than or equal to 99.8%. When said composition is mixed directly with the butane in the tank of the lighter, it is preferable to use 30% by mass of liquefied butane and 70% of a solution comprising 40 g/l of orthoboric acid in methanol. Unexpectedly, the Applicant has observed that the composition having the above-specified proportions is stable (no decomposition, no separation of phases when used in the range 0° C. to 40° C. at 1 bar to 3 bars) and provides a flame without sputtering, and that the combustion products are non-toxic. It is also possible to use 20% to 80% butane and obtain satisfactory results.

In another embodiment of a composition of the invention, intended to impart a red tint to the flame, it is preferable to use a solution of lithium formate in methanol at a concentration in the range 7 g/l to 10 g/l. The methanol is preferably methanol having purity of 99.8% minimum.

Finally, a composition of the invention makes it possible to impart a particularly stable tint to the flame. The composition is also completely stable, which makes it possible, in particular, to gel it, or to use it to impregnate a medium. Finally, the combustion products are non-toxic for all of the above-described compositions giving green and red tints.

Other characteristics and advantage of the invention appear on reading the following detailed description of seven non-limiting embodiments of the invention, and on examining the accompanying drawings, in which:

FIG. 1 is an axial section view of a lighter comprising a first embodiment of the invention;

FIGS. 2A, 2B, and 2C show certain component parts of the FIG. 1 lighter in isolation;

FIG. 3 is an axial section view of a lighter comprising a second embodiment of the invention;

FIGS. 4A, 4B, 4C, and 4D show certain component parts of the FIG. 3 lighter in isolation;

Figure 1:
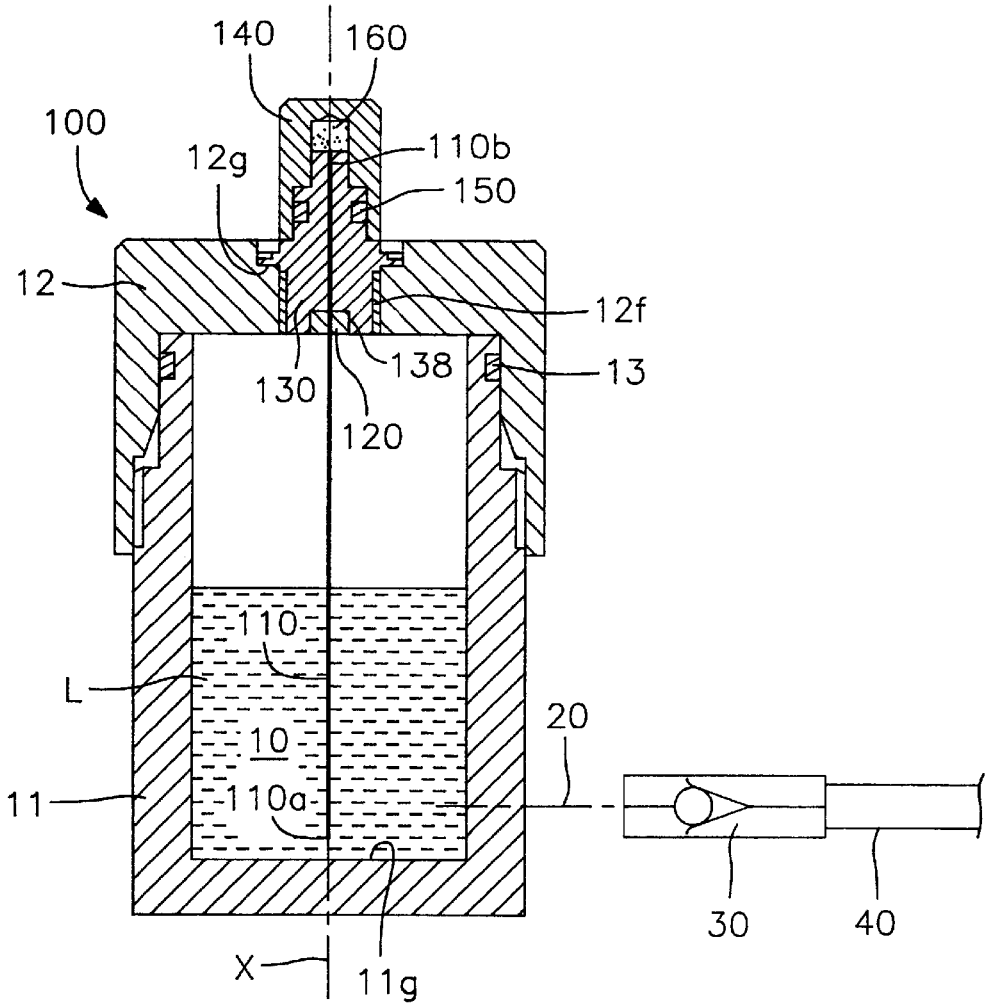

The four lighters 100, 300, 500, and 700 of the invention and shown respectively in FIGS. 1, 3, 5, and 7 all have the same tank 10. Each of the three lighters shown respectively in FIGS. 8, 11, and 14 has a tank 1000. All of these tanks are intended to contain a flammable mixture L stored under pressure, and constituted in the present case by 30% by mass of liquefied butane and 70% of a solution of 40 g/l of orthoboric acid in methanol. The mixture is intended to impart a green tint to the flame, but naturally, it is possible to select a different composition as a function of the tint to be imparted to the flame. In particular, it is possible to use other tinting agents and other flammable volatile liquids, in particular other alcohol solutions of metal salts mixed with other alkanes, in proportions such that the mixture forms a single liquid phase (i.e. a solution of alcohol and alkane in proportions such that they are fully miscible in each other), as explained below.

The tank 10 is formed by uniting a tank bottom body 11 that is circular symmetrical about an axis of symmetry X, and open to the top with a tank top body 12 also circularly symmetrical about the same axis, and screwed onto the bottom body 11. An O-ring 13 is interposed radially between the top body 12 and the bottom body 11 to provide sealed closure of the tank 10. Naturally the shape of the tank 10 can be modified without going beyond the ambit of the present invention, for example it is possible to use a one-piece tank 10 obtained by molding.

Figure 3:
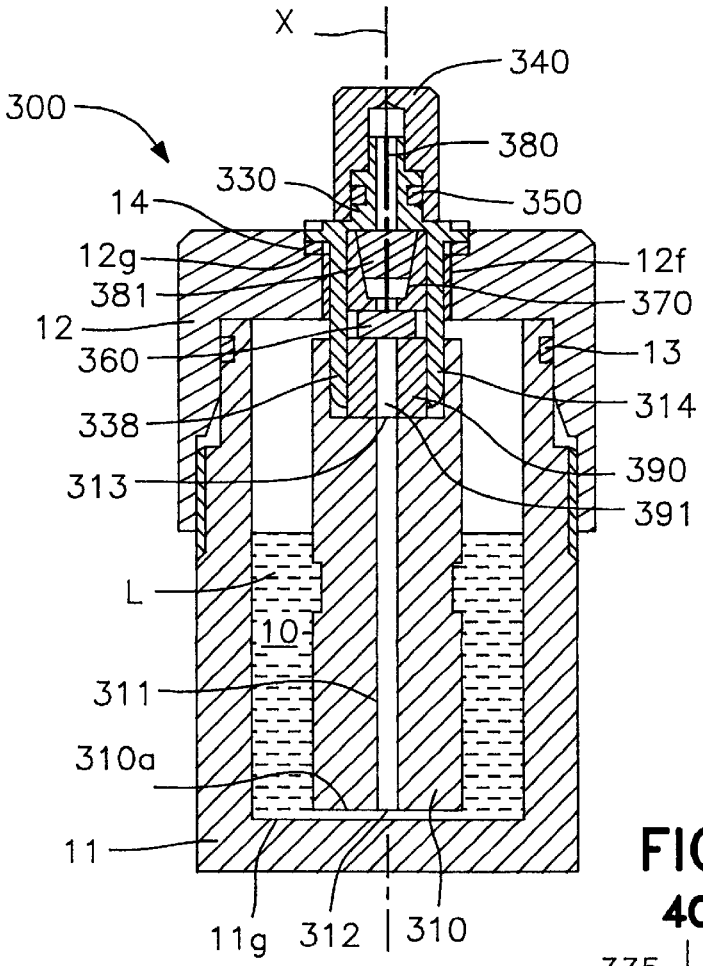
Figure 5:
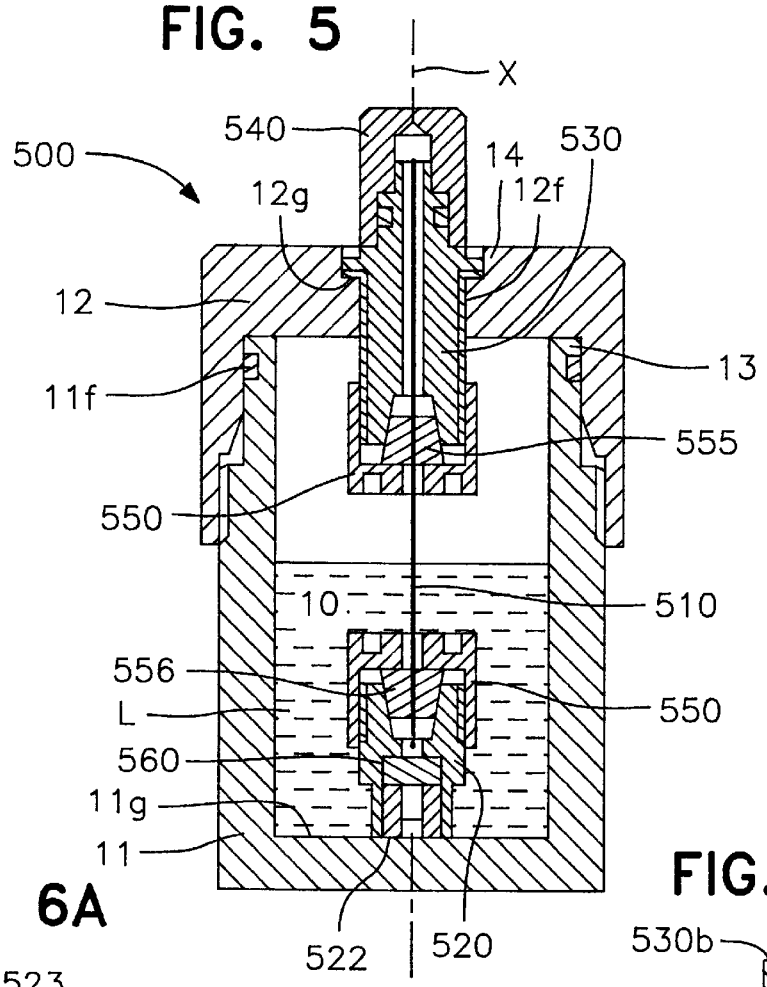
FIG. 5 is an axial section view of a lighter comprising a third embodiment of the invention.

A tapped hole 12*f* centered on the axis X passes through the top body 12 of the tank 10 in order to receive a burner-forming part referenced respectively 130, 330, and 530 for the lighters shown in FIGS. 1, 3, and 5. The end of the tapped hole 12*f* remote from the tank 10 opens out into a spot face 12*g*.

Figure 2A:
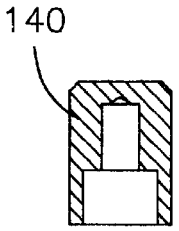
Figure 2B:
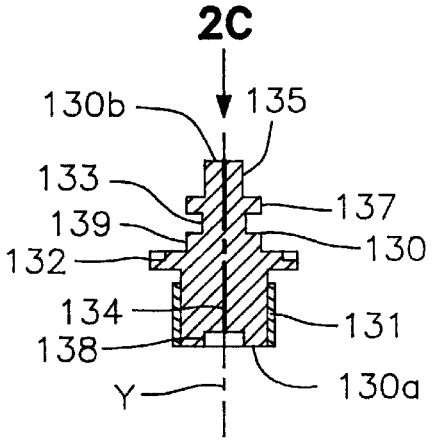

The burner-forming part 130 shown in isolation in FIG. 2B is generally circularly cylindrical in shape about an axis Y that coincides with the axis X when the part 130 is engaged in the tapped hole 12*f* by means of a thread extending over a portion 131 of its length, starting from its bottom end face 130*a* that is located inside the tank 10. The part 130 has a collar 132 that comes axially into abutment against the spot face 12*g*, and above the collar 132 it has a collar 137 of smaller radius which co-operates with a shoulder 139 that extends axially from the collar 132 away from the bottom end face 130*a* to define an annular recess 133 for receiving a sealing ring 150 that is intended to provide sealed closure of the burner, as explained below. Above the collar 137, the part 130 has a cylindrical top portion 135. The part 130 has a longitudinal channel 134 passing through it along its axis Y and intended to receive a capillary tube 110. The part 130 has a plane top end face 130*b* that is perpendicular to the axis Y and the longitudinal channel 134 opens out into said face to feed a porous filter 160 applied thereto with the flammable mixture L taken from the bottom of the tank 10.

In the example described, the porous filter 160 is constituted by a ceramic pellet 160 stuck to the top end face 130*b*. This ceramic pellet 160 is circularly cylindrical in shape about the axis Y, being defined axially by two plane end faces perpendicular to the axis Y and extending the outer cylindrical surface of the top portion 135. The ceramic pellet 160 is fed with mixture L via the capillary tube 110, which is rectilinear and extends along the axis X, having its bottom end 110*a* situated slightly above the bottom 11*g* of the tank 10 so as to remain immersed in the mixture L until it has substantially all been used up. The capillary tube 110 extends along the channel 134 passing through the part 130, and its top end 110*b* is situated immediately below the ceramic pellet 160. The capillary tube 110 is held axially in the channel 134 by means of a drop of adhesive 120 disposed in a cylindrical setback 138 formed in the bottom end face 130*a* of the part 130. In the example described, the capillary tube 110 is a copper tube, and the ceramic pellet 160 has a height measured along the Y axis lying in the range 1 mm to 5 mm, and a diameter of 5 mm.

When the lighter is not in use, a cover 140 covers the surface of the ceramic pellet 160 that is exposed to the air so as to avoid loosing mixture L. The cover 140 shown in isolation in FIG. 2A is internally stepped and fits closely over the ceramic pellet 160 and the top portion 135 of the part 130, engaging the O-ring 150 in sealing manner, as shown in FIG. 1.

Figure 2C:
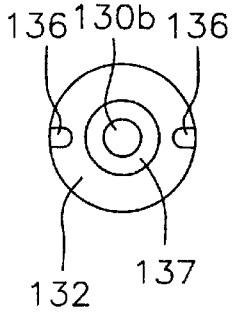

The collar 132 of the part 130 has two recesses 136 in its top face, as can be seen in plan view looking along arrow II in FIG. 2C, these recesses are diametrically opposite and intended to engage complementary projections of a tool for screwing the part 130 in the tapped hole 12*f*. The part 130 is preferably made of metal so as to withstand the heat of the flame.

In the embodiment described above, as in the three following embodiments, the tank 10 is filled initially by filling the inside of the bottom body 10 with the alcohol solution and then with the top body 12 screwed in place, by injecting liquid butane under pressure into the tank 10 by means of a conventional filler device which is shown very diagrammatically. The filler device comprises a nozzle 20 that communicates with the inside of the tank 10 and a non-return valve 30 that is fed during filling from a pipe 40 containing butane under pressure. After filling, the pipe 40 can be disconnected, with the non-return valve 30 preventing the mixture L contained in the tank 10 from escaping.

In this first embodiment of the invention, the porous filter 160 is fed with flammable mixture by means of a capillary tube 110. Because the mixture travelling along the capillary tube is subject to headloss it feeds the filter at a pressure that is lower than the pressure that obtains inside the tank, and it also serves to prevent premature dissociation of the mixture flowing along it by keeping the butane in the liquid state.

Figure 4A:
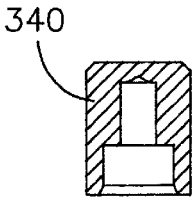
Figure 4B:
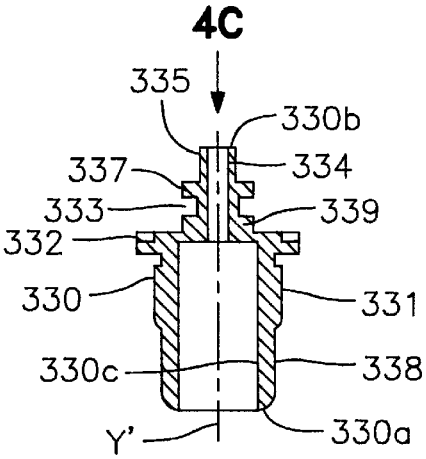

The part 330 fitted to the lighter 300 and shown in isolation in FIG. 4B is generally circularly cylindrical in shape about an axis Y' that coincides with the axis X when the part 330 is screwed into the tapped hole 12*f*. A portion 331 of length of the part 330 is threaded for assembly in the tapped hole 12*f*, and the part has a collar 332 for coming axially into abutment in the spot facing 12*g* with the sealing ring 14 being interposed.

Figure 4D:
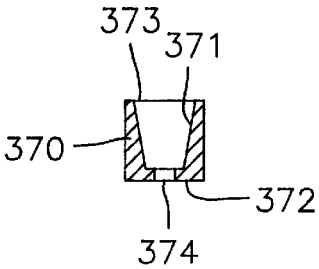
Figure 4C:
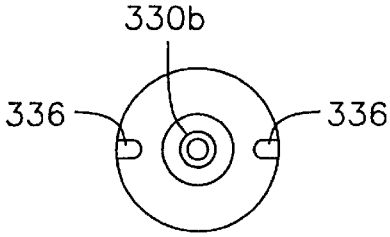

On its top end face, this collar 332 has two diametrically opposite recesses 336 visible in the plan view looking along arrow IV of FIG. 4C, for engaging complementary projections of a tool (not shown) for screwing the part 130 into the tapped hole 12*f*. The collar 332 is extended axially away from the threaded portion 331 by a shoulder 339 co-operating with a second collar 337 to define an annular recess 333 for receiving a sealing ring 350.

The part 330 has a top end face 330*b* that is plane and perpendicular to the axis Y', and between said end face and the collar 337 it has a cylindrical portion 335. The part 330 has an internal bore running from its bottom end face 330*a* so as to form a cylindrical housing 330*c* that is to receive a porous filter 360 together with means for installing it and treating it with flammable mixture L, as described below.

The end of the housing 330*c* is situated axially level with the collar 332, and it communicates with the outside of the lighter via a channel 334 extending along the axis Y', having its top end opening out in the end face 330*b*. The part 330 has a threaded portion 338 extending axially between the bottom end of the threaded portion 331 and the bottom end face 330*a*, projecting into the tank 10 and serving to receive a rod 310 for feeding the porous filter 360 with flammable mixture L. In the example described, the rod 310 is in the form of a body that is generally circularly cylindrical about the axis X, being tapped at its top end for screw engagement on the threaded portion 338. This portion is naturally of smaller diameter than the threaded portion 331 so as to enable the part 330 to be inserted in the tapped hole 12*f*.

The length of the rod 310 is selected so that its bottom end 310*a* leaves a gap between the bottom 11*g* of the tank 10 and the bottom end 312 of a longitudinal channel 311 running along the rod 310, thereby enabling it to communicate with the inside of the tank 10. The longitudinal channel 311 extending along the axis X is of a diameter that is large enough to impart little headloss to the mixture running therealong and its top end 313 opens out into the bottom of the tapped hole 313 that receives the part 330. The porous filter 360 is held inside the housing 330*c* between a bottom support 390 and a top support 370 both having radial outer surfaces that are cylindrical and that fit closely against the cylindrical surface of the housing 330*c*. The bottom support 390 is defined axially by two end faces, one bearing against the bottom of the tapped hole 338 and the other against the porous filter 360, and it has a channel 391 passing therethrough along the axis X.

The top support 370 which is shown in isolation in FIG. 4D has a bottom end face 372 which is plane and perpendicular to the axis X that is intended to rest against the porous filter 360, and the support 370 also has a conical housing 371 that opens out into its top end face 373. The section of the housing 371 tapers going away from the top end face 373, and the bottom of the housing 371 is connected by a hole 374 to the bottom end face 372. The porous filter 360 is in the form of a ceramic pellet analogous to the above-described pellet 160, being circularly cylindrical about the axis X, and of diameter smaller than the diameter of the housing 330*c* but larger than the diameter of the longitudinal channel 312. It is defined axially by two plane end faces perpendicular to the axis X and bearing respectively against the bottom support 390 and the top support 370.

A support cone 381 is engaged in the housing 371 and is complementary in shape thereto. This cone 381 has a rectilinear capillary tube 380 extending along its axis X with the bottom end thereof being situated in the hole 374 immediately above the porous filter 360 and the top end thereof opening out into the top end face 330*b* of the part 330.

The stack constituted by the bottom support 390, the porous filter 360, the top support 370, and the support cone 381 is secured axially against the end of the housing 330*c* and the bottom of the tapped hole 314 by screwing the rod 310 on the threaded portion 338. A cover 340 that is similar in shape to the above-described cover 140 prevents the mixture L from escaping while the lighter is not in use.

When the cover 340 is removed, the mixture L rises under the effect of the pressure of the gas situated above the surface of the mixture L in the tank 10, passing along the channel 311 of the rod 310 and the channel 391 of the bottom support, it expands as it passes through the porous filter 360, and it leaves in at least partially liquid form at low relative pressure via the top end of the capillary tube 380, to burn when ignited by any known igniter means (not shown).

The burner-forming part 530 fitted to the lighter 500 is generally circularly symmetrical in shape about an axis Y" which coincides with the axis X when the part 530 is mounted in the top body 12. This part is threaded over a portion 531 of its length extending from its bottom end face 530*a* so as to screw in the tapped hole 12*f*, and it has a collar 532 that comes axially into abutment against the spot facing 12*g* with a sealing washer 14 being interposed. The portion of the part 530 extending above the collar 532 is identical to the portion of the part 330 extending above the collar 332 and is not described again.

The bottom of the part 530 has a conical housing 530*c* which opens out into the bottom front face 530*a*, and its section tapers going away therefrom. A longitudinal channel 534 extending along the axis Y" passes through the part 530 from its top front face 530*b* to the end of the housing 530*c*.

The length of the threaded portion 531 is greater than the length of the tapped hole 12*f*, so the part 530 projects into the tank 10 for mounting a capillary tube 510. More particularly, the capillary tube 510 is mounted by means of a first support cone 555 inserted in part in the housing 530*c*. This cone 555 is held in place by screwing a retaining ring 550 onto the threaded portion 531 of the part 530 and at its bottom end it is of section that is larger than the section of the opening 530*c*, thereby making it possible to achieve sealed clamping of the cone in the housing 530*c* by tightening the ring 550. The ring has two diametrically opposite setbacks 551 for receiving complementary projections of a tool for tightening it.

The support cone 555 has the capillary tube 510 passing therethrough which extends along the longitudinal channel 534 above the cone 555 to the top end face 530*b*, and which also extends beneath the cone 555 through a hole 552 in the ring 550 to the vicinity of a porous filter 560.

Figure 6A:
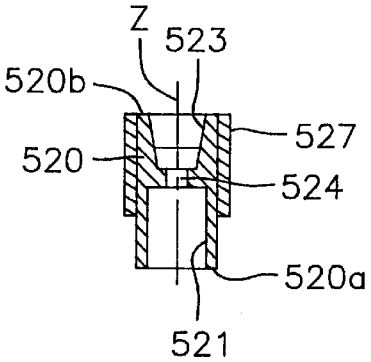
FIGS. 6A to 6F show certain component parts of the FIG. 5 lighter in isolation.
Figure 6B:
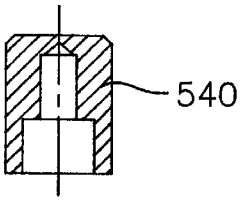
Figure 6C:
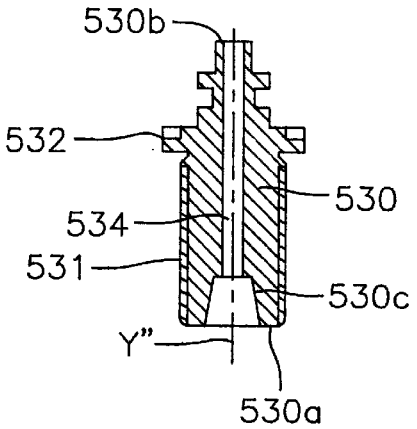
Figure 6E:
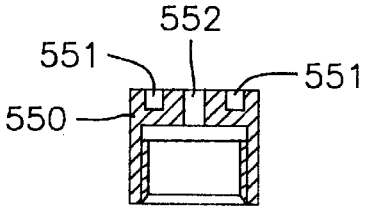
Figure 6F:
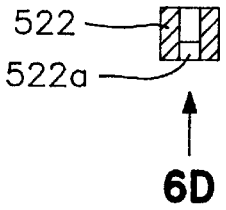
Figure 6D:
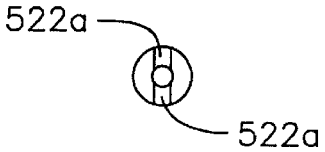

The filter is held in place close to the bottom of the tank 10 by a support 520 which is fixed by its bottom end face to the bottom 11g of the tank 10. The porous filter is received in an internal housing 521 that is circularly cylindrical about an axis Z that coincides with the axis X when the support is in place in the tank 10, and the filter 560 is held axially fixed against the end of the housing 521 by a ring 522 that is interposed 15 axially between the porous filter 560 and the bottom 11*g* of the tank 10. The ring 522 has diametrically opposite radial channels 522*a* as shown in the view from beneath of FIG. 6D and the support 520 is provided with radial openings so as to allow the mixture L to reach the inside of the ring 522 and the bottom end face of the porous filter 560. As in the preceding embodiment, the filter is in the form of a circularly cylindrical ceramic pellet.

The top of the support 520 has a conical housing 523 opening out into its top end face 520*b*. The section of the housing 523 tapers towards the bottom end face 520*a* and the bottom of the housing 523 communicates with the end of the housing 521 via a hole 524.

A support cone 556 is inserted in part into the housing 523 to hold the bottom portion of the capillary tube 510 in place.

The top portion of the cone 556 has a section that is greater than the section of the opening to the housing 523 such that its top end face projects above the top end face of the support 520. The cone 556 can then be clamped in the housing 523 by tightening a ring identical to above-described ring 550 which engages an outside thread 527 of the support 520.

When the lighter 500 is not in operation, the top end of the part 530 is covered by a cover 540 identical to above-described cover 340. The porous filter 560 situated close to the bottom of the tank remains immersed and impregnated with the mixture L until nearly all of it has been used up. When the lighter is in operation, the mixture L passes through the radial passages 522*a* in the ring 522 and the openings in the support 520, expands as it passes through the porous filter 560, and penetrates into the bottom end of the capillary tube 510, and it leaves the capillary tube 510 still partially in the form of a liquid via the top end of the tube outside the lighter 500.

Figure 7:
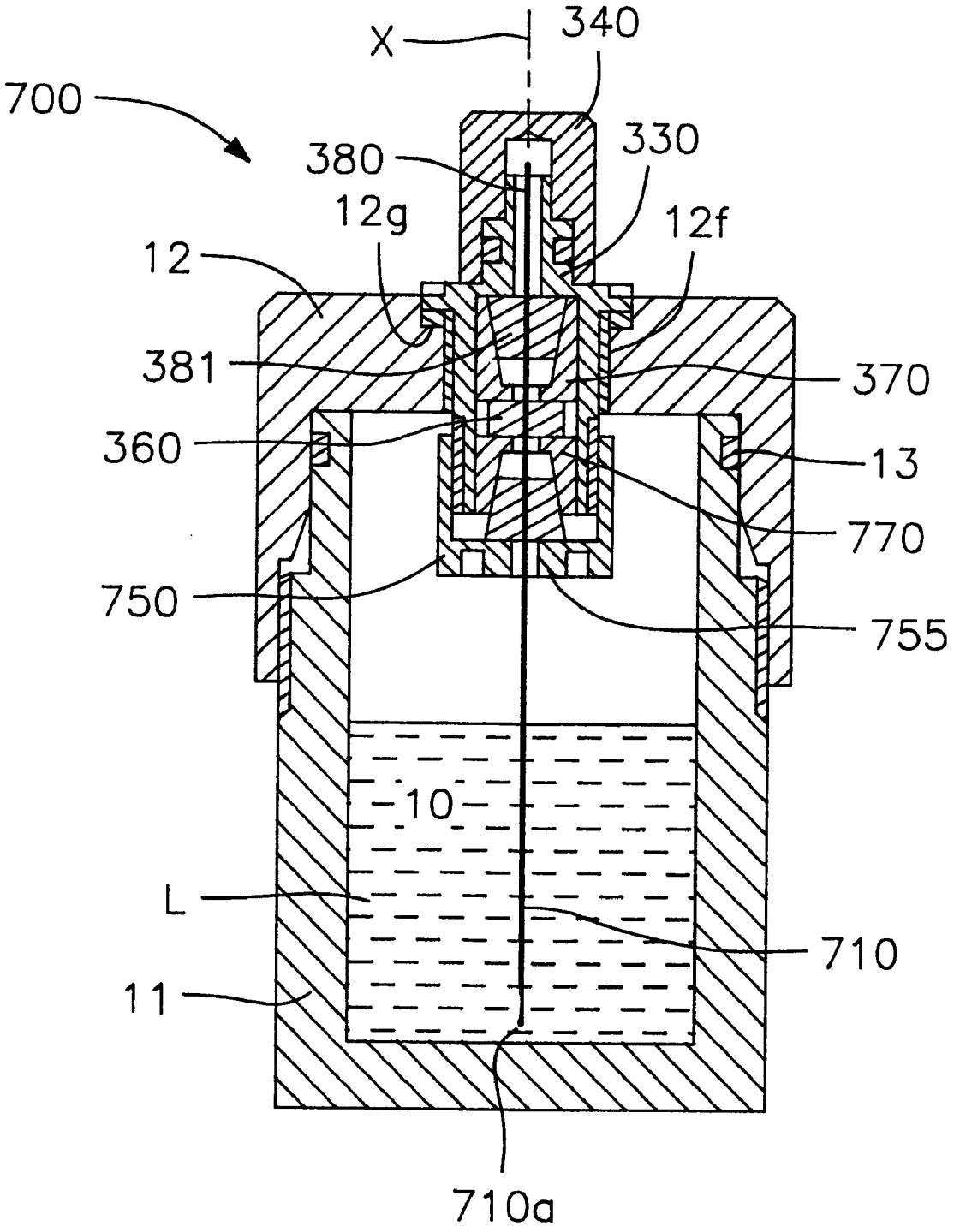
FIG. 7 is an axial section view of a lighter comprising a fourth embodiment of the invention.

The lighter 700 shown in FIG. 7 differs from the lighter 300 shown in FIG. 3 by the fact that the rod 310 and the bottom support 390 are omitted, the rod 310 being replaced by a capillary tube 710 held by a cone 755 identical to above-described cone 555 and engaged in part in a support 770 identical to support 370 but mounted the opposite way up in the housing 330*c*, the new assembly being held axially in the housing 330*c* by tightening a ring 750 identical to the ring 550. The bottom end 710*a* of the capillary tube 710 opens out close to the bottom of the tank 10 in order to extract mixture L until the mixture has nearly all been used up.

Without going beyond the ambit of the invention, the above-described covers used to prevent the mixture L escaping can be replaced by any known valve device suitable for use in gas lighters.

The capillary tubes used in the embodiments described with reference to FIGS. 1 to 7 have an inside diameter of 0.25 mm. Naturally, this diameter could be modified to set the flow rate of the mixture to any desired value.

Figure 8:
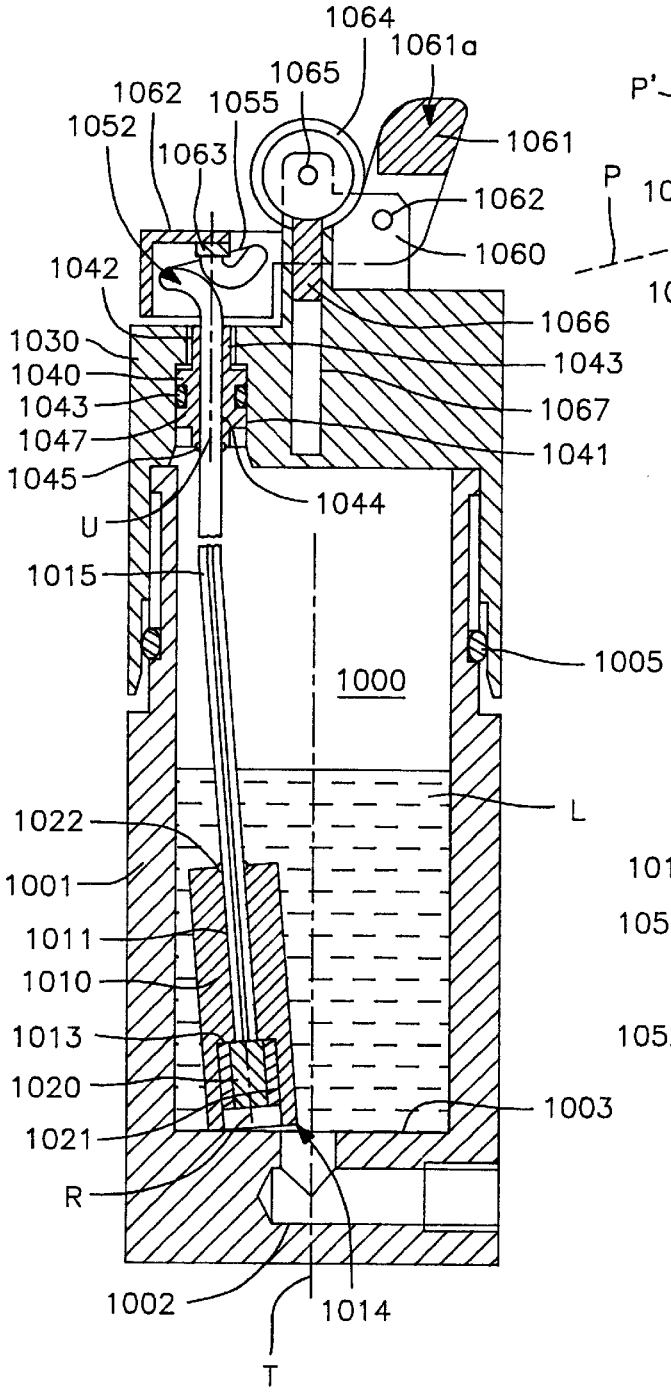
FIG. 8 is an axial section view of a lighter comprising a fifth embodiment of the invention.
Figure 10:
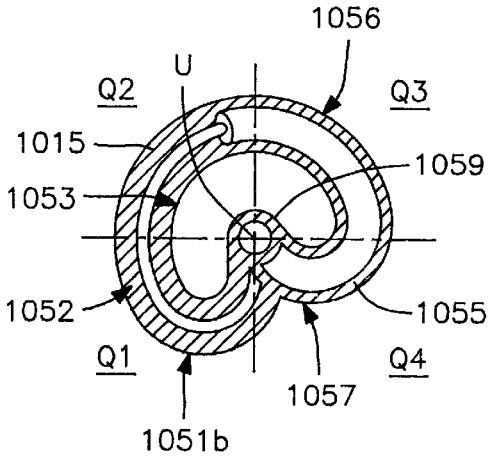
FIG. 10 is a plan view seen along arrow X of FIG. 9.
Figure 11:
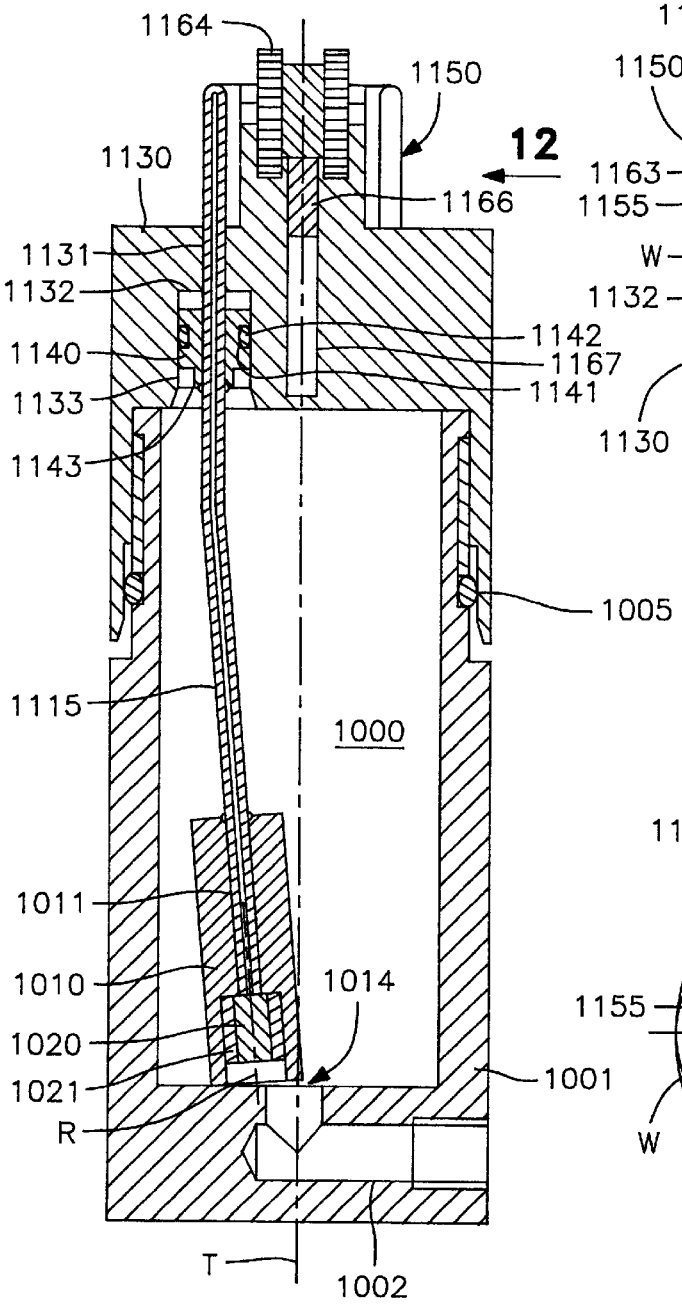
FIG. 11 is an axial section view of a sixth embodiment of a lighter of the invention.
Figure 13:
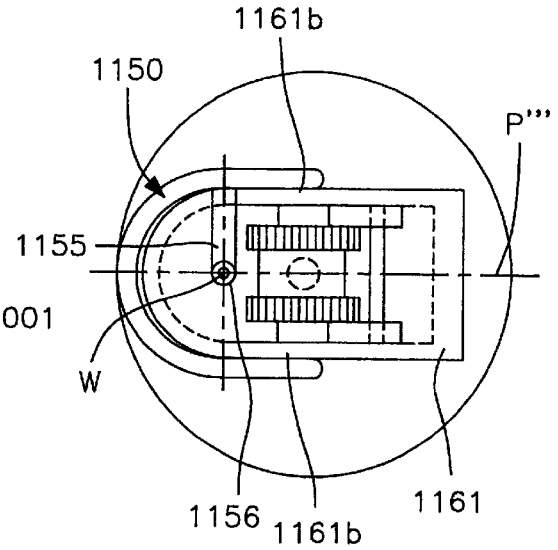
FIG. 13 is a plan view seen along arrow XIII of FIG. 12.
Figure 14:
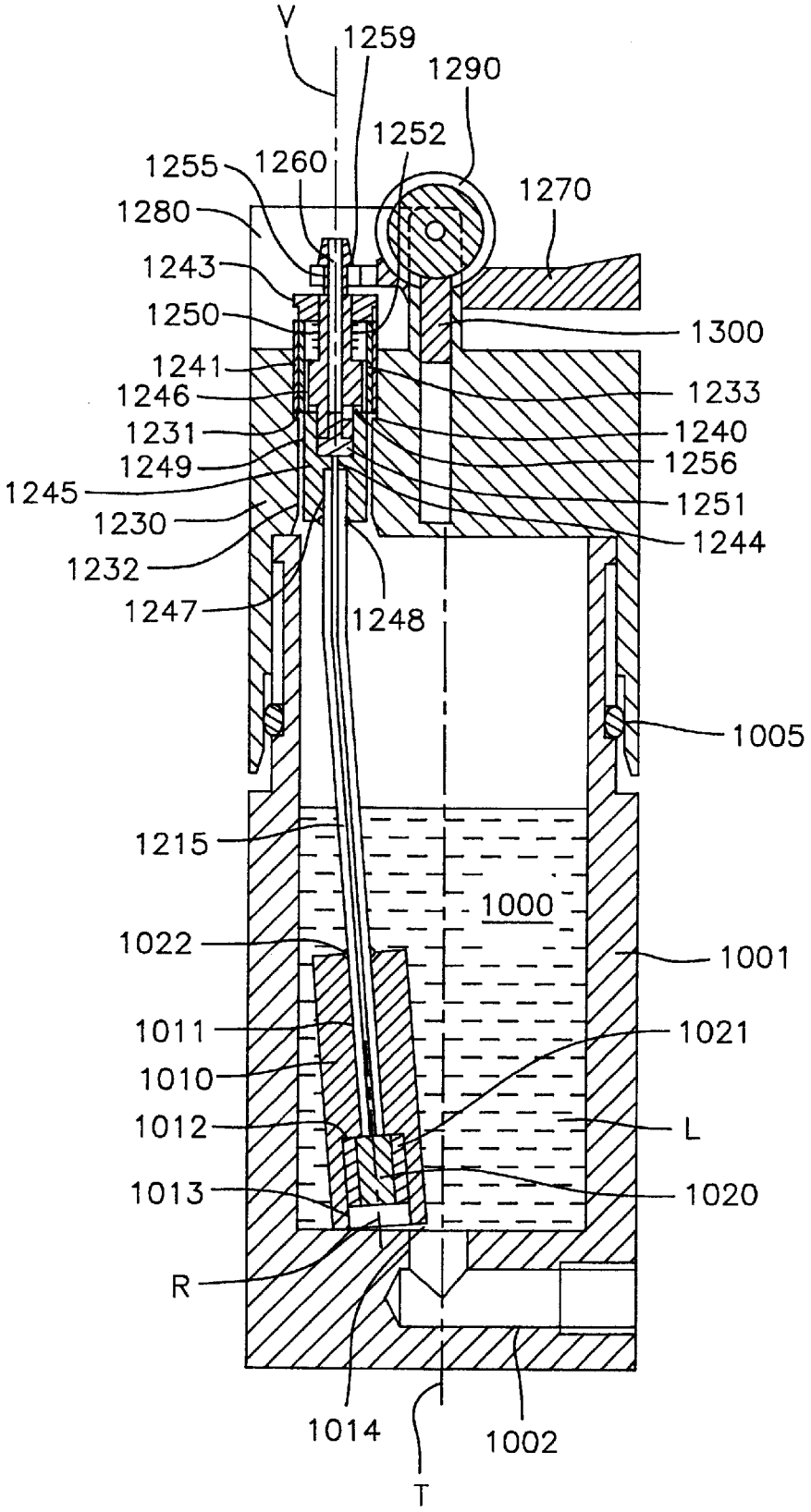
FIG. 14 is an axial section view of an eighth embodiment of a lighter of the invention.

The tank 1000 of the lighters shown in FIGS. 8, 11, and 14 is formed by screwing together a tank bottom body and a tank top body, with an O-ring 1005 being interposed for sealing purposes. The bottom body of the tank is identical in all of the lighters shown in FIGS. 8, 11, and 14 and it is given reference 1001. It is elongate along a longitudinal axis which also constitutes a general axis of symmetry T for the embodiments of FIGS. 8 to 14. Naturally, it is also possible to use a tank bottom body 1001 having a cross-section other than circular, e.g. oval. The bottom body 1001 has a filler duct 1002 formed in its base and opening out at one end through the bottom 1003 of the body, the other end of the duct opening out in the radially outermost side surface of the body. A conventional non-return valve (not shown) is housed inside the duct 1002 for filling the tank.

A porous filter support 1010 is mounted at the bottom end of a capillary tube given respective references 1015, 1115, and 1215 in the embodiments of FIGS. 8, 11, and 14. This capillary tube dips into the tank 1000 and its top end is open outside the tank.

The porous filter support 1010 is generally in the form of a circular cylinder about an axis of symmetry R having a central opening 1011 passing therethrough on said axis and in which the capillary tube is engaged. One end of the central opening 1011 opens out in the top end face of the support 1010, and its other end is enlarged to form a housing 1013 which opens out into the bottom end face of the support 1010 and which is intended to receive a porous filter 1020 of the same type as those described above. The axis of symmetry R of the support 1010 is inclined slightly relative to the longitudinal axis T of the tank bottom body 1001 so as to leave a gap 1014 between the bottom end face of the support 1010 and the bottom 1003 of the tank bottom body 1001, thereby enabling the liquid mixture L to reach the porous filter 1020. The filter comes axial into abutment against the end of the housing 1013 and it is held therein by sealing means 1021 engaged between the radially outer surface of the filter 1020 and the radially inner surface of the housing 1013. These sealing means 1021 are constituted in the embodiments described with reference to FIGS. 8, 11, and 14 by an annular layer of tin, the porous filter 1020 being constituted by a ceramic pellet that is tinned on its radially outer surface, and the support 1010 is made of copper. In a variant, it is possible to provide the periphery of the porous filter 1020 with a "Teflon" ring which is forced into the hosing 1013. The capillary tubes 1015, 1115, and 1215 of the lighters shown in FIGS. 8, 11, and 14 are held where they leave the support 1010 by a drop of solder or adhesive 1022 applied to the top end face of the support 1010.

In the embodiment of FIG. 8, the capillary tube 1015 passes through the tank top body, given reference 1030 inside an assembly piece 1040 that is circularly symmetrical about an axis U parallel to the longitudinal axis T of the bottom body 1001 of the tank. The assembly piece 1040 is engaged in a spot face 1041 whose bottom end opens out into the tank 1000. The spot face 1041 is extended at its top end via a tapped hole 1042 which opens to the outside of the tank top body 1030. The assembly part 1040 has a bottom portion 1047 that fits inside the spot face 1041, with its radially outer surface including a groove that receives a sealing O-ring 1043 that is interposed radially between the assembly part 1040 and the radially inside surface of the spot face 1041. The assembly part 1040 includes a threaded top portion 1043 that is screwed into the tapped hole 1042. The capillary tube 1015 passes along the inside of the assembly part 1040 on its axis U via a central opening 1044, and it is held in place in the assembly part 1040 by means of a drop of adhesive or solder 1045 applied to the bottom end face thereof. The capillary tube 1015 leaves the assembly part 1040 outside the lighter via a coil-shaped portion 1052 that is intended to recover some of the heat given off by the flame.

A tube 1055 having an inside diameter greater than that of the capillary tube 1015 is connected end to end therewith to constitute a mixture vaporizing duct. In the example described, the vaporing duct tube 1055 used has an outside diameter that is identical to that of the capillary tube 1015.

Figure 9:
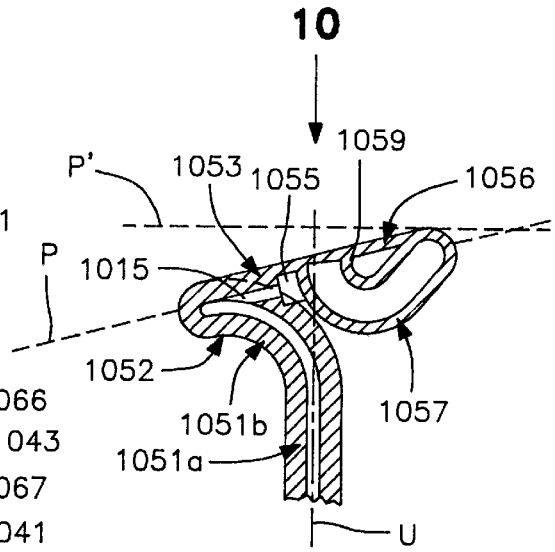
FIG. 9 shows, on a larger scale, and in isolation the vaporization duct shown in FIG. 8.

FIG. 9 shows the coil portion 1052 and the vaporizing duct tube 1055 that extends it. The capillary tube 1014 leaves the assembly part 1040 rectilinearly along the axis U. The corresponding portion is referenced 1051*a*. The axis U corresponds to the interaction of two mutually perpendicular planes defining four quadrants respectively referenced Q1, Q2, Q3, and Q4 in the clockwise direction about the axis U, as shown in FIG. 10. The portion 1051*a* extends into the first quadrant Q1 via a curvilinear portion 1051*b* which, when seen from above, describes a U-shape with its branches extending parallel to the plane between the quadrants Q1 and Q2. The curvilinear portion 1051*b* extends upwards in the second quadrant Q2 via a portion 1053 describing substantially an arc of a helix over an angle of approximately 75° about the axis U. The capillary tube 1015 intersects the plane between quadrants Q1 and Q2 perpendicularly. As a result, the junction plane between the capillary tube 1015 and the vaporization duct tube 1055 contains the axis of symmetry U and is at an angle of about 75° relative to the plane separating quadrants Q1 and Q2. The portion 1053 is extended by a portion 1056 of the vaporizing duct tube 1055 describing the same helix as the portion 1053 over an angle of approximately 115° about the axis U. Together, the portions 1053 and 1056 as seen from above describe approximately a semicircle centered on the axis U and extending parallel to a plane P that is inclined at 75° relative to the axis U. The portion 1056 extends clockwise in FIG. 10 from the junction plane between the quadrants Q3 and Q4 in the form of a curvilinear portion 1057 terminated by an outlet section 1059 that is coaxial about the axis U and it lies beneath the plane which is tangential with the top of the combined portions 1053 and 1056 and parallel to the plane P. The outlet section 1059 is thus situated beneath a plane P' perpendicular to the axis U and tangential to the top of the portion 1056 of the vaporizing duct tube 1055. In the embodiment described, the inside diameter of the tube 1055 forming the vaporizing duct lies in the range 0.5 mm to 1 mm and the inside diameter of the capillary tube is 0.33 mm. The axis U also corresponds to the axis of the flame when the lighter is alight, said axis being vertical under normal conditions of use.

A shutter actuated by a pushbutton 1061 is hinged about an axis 1062 to a support 1060 connected to the tank top body 1030. The axis 1062 is contained in a plane perpendicular to the longitudinal axis T. The pushbutton 1061 has an end 1061*a* on which the user acts, and an opposite end with a downwardly curved snuffer 1062 which covers the capillary tube 1015 and the vaporizing duct tube 1055 to protect them when the pushbutton is at rest. The snuffer 1062 is provided on its bottom surface with a gasket 1063 that presses, when no pressure is being exerted on the pushbutton 1061, on the outlet section 1059 of the vaporizing duct tube 1055 to close it. In the embodiment described, the angular displacement of the pushbutton 1061 is 80°. The pushbutton 1061 is urged towards its closure position in conventional manner by a spring (not shown).

A flint wheel 1064 is mounted to rotate on the support 1060 about an axis parallel to the axis 1062 and a flint 1066 is pressed against the wheel 1064 in conventional manner to produce ignition sparks when the wheel is rotated by the user. The flint 1066 is slidably mounted in a blind hole 1067 formed in the tank top body 1030 and it is urged against the wheel 1064 by a return spring (not shown) operating in compression between the end of the blind hole 1067 and the bottom end face of the flint 1066.

Figure 12:
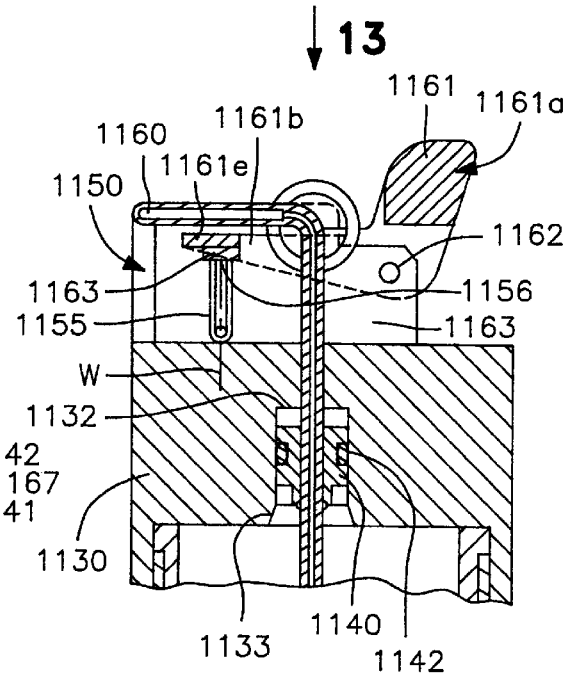
FIG. 12 is a side view seen along arrow XII of FIG. 11.

In the embodiment shown in FIGS. 11 to 13, the capillary tube, referenced 1115, passes through the tank top body 1130 via a stepped passage 1131. This passage 1131 is circularly cylindrical about an axis parallel to the axis T and its top end opens to the outside of the lighter while its bottom end is enlarged to form a housing 1133 whose own bottom end opens out into the tank 1000. The housing 1133 receives a sealing part 1140 with the capillary tube 1115 passing axially therethrough. The sealing part 1140 is generally circularly symmetrical and its radially outer surface has an annular groove for receiving a sealing O-ring 1142. The ring is interposed radially between the sealing part 1140 and the housing 1133. Sealing between the capillary tube 1115 and the part 1140 is provided by a drop of adhesive or solder 1141 applied to the capillary tube and to the bottom end face of the part 1140. The capillary tube 1115 extends perpendicularly to the longitudinal axis T where it leaves the tank top body 1130 outside the lighter, after which it follows a 90° bend to be connected to a vaporization duct 1160. The capillary tube extends over the tank top body 1130 parallel to a plane containing the longitudinal axis T and referenced P''' in FIG. 13.

In the embodiment shown in FIGS. 11 to 13, the vaporization duct is formed inside a flame guard 1150 which is U-shaped when seen in plan view, as shown more particularly in FIG. 13, the concave side of the U-shape facing towards an axis W parallel to the longitudinal axis T of the tank bottom body 1001, and the branches of the U-shape extend parallel to the plane P'''. The flame guard 1150 is preferably constituted by two stamped metal sheets assembled to each other and forming between them the above-mentioned vaporization duct 1160. The inside diameter of this duct is greater than that of the capillary tube and preferably lies in the range 0.5 mm to 1 mm. In the curvilinear portion of the U-shape, the vaporization duct 1160 extends parallel to a plane perpendicular to the axis W, and then in the branch of the U-shape remote from that into which the capillary tube 1115 opens out extends downwards towards the tank top body 1130. At the base of the flame guard 1150, the duct 1160 connects to an outlet tube 1155 that follows a right angle bend and whose outlet section 1156 is coaxial about the axis W. Sealing between the capillary tube 1115 and the vaporization duct 1160 inside the flame guard 1150 is achieved by clamping the capillary tube between stamped portions of the two pieces of sheet metal constituting it. The outlet section 1156 is situated beneath the plane that is tangential with the top of the vaporization duct 1160, such that when the lighter is in operation said duct is subjected to the heat given off by the flame.

A shutter actuated by a pushbutton 1161 is hinged about an axis 1162 on a support 1163 fitted to the tank top body 1130. A flint wheel 1164 is mounted to rotate about an axis parallel to the axis 1162 to strike in conventional manner against a flint 1166 located in a blind hole 1167 of the tank top body 1130. The flint 1166 is urged against the wheel 1164 by a spring operating in compression and not shown. The pushbutton 1161 serves to rotate two branches 1161*b* that extend away from the user-engaging portion 1161*a*, on either side of a midplane of the flint wheel and perpendicularly to its axis. These two branches 1161*b* are united by a bridge of matter 1161*c* at their ends remote from the portion 1161*a*. A gasket 1163 for pressing against the outlet section 1156 of the outlet tube 1155 is disposed beneath the bridge of matter 1161*c* to close the outlet tube when the pushbutton is at rest. The pushbutton 1161 is urged towards its closure position by a spring (not shown).

In the embodiment of FIG. 14, the capillary tube 1215 is inserted at its top end in a support part 1240. This support part 1240 has a bottom portion 1245 and a top portion 1241 that are assembled together by screw engagement after a non-return valve member 1250 and a return spring 1252 therefor has been mounted inside these two portions. The non-return valve member 1250 is guided in sliding by the support part 1240 along an axis V parallel to the longitudinal axis T of the tank bottom body 1001. The top portion 1241 is generally in the form of a sleeve having inside and outside threads and narrowed inwardly at its top end through which the valve body 1250 passes to form a radially inner collar 1243. The top portion 1241 is screwed into a tapped hole 1233 of the tank top body 1230 until it comes into axial abutment against a transverse shoulder 1231 defining the bottom of said tapped hole. The tapped hole 1233 is extended beneath the shoulder 1231 by a circularly cylindrical surface 1232 about the axis V, having an inside diameter that is smaller than that of the tapped hole 1233 and opening out at its bottom end into the tank 1000.

The bottom portion 1245 of the support part 1240 is threaded at its top end 1246 for screw engagement inside the top portion 1241. It has an internal bore at 1247 extending from its end face over about one-third of its length to receive the top end of the capillary tube 1215. The tube is held in the bore 1247 by a drop 1248 of solder or of adhesive. The bottom portion 1245 of the support part 1240 has an internal bore stepped at 1249 and extending from its top end face to guide the non-return valve member 1250 in sliding. A gasket 1251 mounted at the bottom end of the non-return valve member 1251 is urged by the spring 1252 against the bottom of the bore 1249. The capillary tube 1215 communicates with the bottom of the bore 1249 via a channel 1244 that is coaxial with the axis V and that has the same diameter as the inside diameter of the capillary tube 1215. The non-return valve member 1250 has an inside bore 1255 extending along its entire length from the gasket 1251 to its top end for ejecting the mixture. When the gasket 1251 is lifted off the bottom of the bore 1249 by action on the pushbutton 1270, as explained in greater detail below, the mixture leaves the lighter via the bore 1255 that also constitutes a vaporization duct. In accordance with the invention, the mixture escapes from the tank 1000 via the capillary tube 1215 into the non-return valve member 1250, at least partially in the liquid state. A heat conducting rod 1260 for ensuring complete vaporization of the mixture before it leaves the non-return valve member 1250 to be burnt, extends inside the bore 1255 and at its bottom end it has a leg secured in the non-return valve member 1250. This member has an outside shoulder to form a bearing surface for the bottom end of the return spring 1252, the top end thereof being retained by an internal collar 1243 of the top portion 1241 of the support part 1240. A radial channel 1256 is provided to allow the mixture L to pass along the central bore 1255 of the non-return valve member when it is moved upwards by the pushbutton 1270 so that the gasket 1251 no longer closes the channel 1244.

The non-return valve member 1250 is provided at its top end projecting from the support part 1240 with a collar that projects radially outwards and beneath which there is applied the edge of a hole in one of the branches of the pushbutton 1270 of the purpose of raising the member 1250 and causing the mixture L to escape via the central bore 1255. The control pushbutton 1270 is mounted on a support 1280 fitted to or integrally formed with the tank top body 1230, so as to rotate about an axis perpendicular to the longitudinal axis T of the tank bottom body 1001.

As in the embodiments described above with reference to FIGS. 8 and 11, the lighter shown in FIG. 14 is fitted with a flint wheel 1290 and with a flint 1300 that are identical to those described above and that are not described again.

Preferably, as shown, the top end of the rod 1260 projects upwards from the non-return valve member 1250 so as to extract heat from the core of the flame.

The mixture, while still at least partially liquid, escapes from the tank 1000 into the vaporization ducts 1055, 1160, or 1255 as described above, where it is subjected to the heat of the flame. These ducts have an inside diameter greater than that of the corresponding capillary tubes 1055, 1115, and 1215 situated upstream therefrom, thus making it possible to avoid a pressure increase due to the heat given off by the flame since that would serve to extinguish the flame.

The porous filters described are constituted by ceramic pellets advantageously having a pore size lying in the range 1 $\mu$m to 10 $\mu$m, with pore size being defined herein as the smallest size of particles contained in the liquid passing through the ceramic that would be retained thereby. This pore size is large enough to avoid filtering the tinting agent used and small enough for passage through the porous filter to be accompanied by headloss that enables the mixture to be expanded appropriately. The present invention is not limited to these embodiments for the porous filter. Thus, it is possible to replace ceramic pellets as described with porous filters made of sintered plastics material, or of sintered metals or oxides, and it is also possible to alter the shapes of the porous filters described.

Finally, in order to tint the flame of a lighter, the invention makes it possible to use a tinting agent that is mixed with a flammable volatile liquid stored under pressure by using a porous filter to expand the mixture which is sent, while still at least partially in the liquid state, i.e. in the form of a mixture of gas and liquid, to the outside of the tank in order to be burnt. The porous filter is fed by the mixture while it is in the liquid state and under pressure, preferably by means that form a duct for extracting liquid from the bottom of the tank, as described above. Advantageously, the use of a capillary tube upstream from the porous filter serves to add additional headloss and reduce the pressure of the mixture L reaching the porous filter. In such circumstances, the porous filter is preferably located above the level of the mixture L in the tank when the lighter is in its normal position for use, i.e. when the axis X is vertical as shown in FIGS. 1, 3, and 7. In a variant, as shown in the embodiments of FIGS. 5 and 8 to 14, the porous filter is constantly immersed in the mixture. In the embodiments of FIGS. 3, 5, and 7, the use of a capillary tube downstream from the porous filter serves to add additional headloss. In the embodiment of FIG. 7, by using two capillary tubes, one placed upstream and the other downstream from the filter, too high a differential pressure is avoided across the filter. In the embodiments of FIGS. 8 to 14, the use of a vaporization duct downstream from the capillary tube conveying the mixture to the outside of the tank serves to vaporize the mixture while avoiding clogging the capillary tube or the duct with premature deposit of tinting agent, and to obtain an elongate flame similar to that of a conventional gas lighter. One possible explanation may lie in the entrainment effect due to the speed of the gas in the vaporization duct subjected to the heat given off by the flame. This entrainment effect serves to remove any deposit that may accumulate in the vaporization duct. Naturally, the lighters described can be fitted with a conventional valve for adjusting the height of the flame.

We claim:

1. A tinted flame lighter having a tank (10; 1000) suitable for containing a mixture (L) under pressure of a tinting agent and a flammable volatile liquid, the lighter being characterized in that it comprises a porous filter (160; 360; 560; 1020) suitable for expanding the mixture delivered to the outside of the tank in order to be burnt while it is still partially in the liquid state, and means for feeding the porous filter with the mixture (L) while it is in the liquid state, a vaporization duct (1055; 1160; 1255) situated outside the tank (1000) and fed with the mixture (L) expanded by the porous filter (1020), said vaporization duct being subjected in use of the lighter to the heat of the flame, wherein the vaporization duct (1160) is integrated in a part constituting a flame guard (1150).

2. A lighter according to claim 1, characterized in that the vaporization duct (1160) is formed between two assembled-together stamped metal sheets of the flame guard forming part (1150).

3. A lighter according to claim 2, characterized in that the capillary tube (1115) situated downstream from the porous filter is connected at one end to said vaporization duct (1160), in that said duct extends along a curve that is convex and is connected to an outlet tube (1155).

* * * * *